United States Patent [19]

Rovinsky

[11] Patent Number: 5,000,013

[45] Date of Patent: Mar. 19, 1991

[54] AIR SEQUENCER FOR A KNITTING MACHINE

[76] Inventor: William Rovinsky, 212 Haypath Rd., Old Bethpage, N.Y. 11804

[21] Appl. No.: 440,713

[22] Filed: Nov. 24, 1989

Related U.S. Application Data

[63] Continuation-in-part of Ser. No. 245,038, Sep. 16, 1988, abandoned.

[51] Int. Cl.[5] ..... D04B 35/32

[52] U.S. Cl. ..... 66/168; 137/627

[58] Field of Search ..... 66/168; 137/627, 864, 137/901

[56] References Cited

U.S. PATENT DOCUMENTS

| | | | |
|---|---|---|---|
| 1,725,280 | 8/1929 | Kiefer | 137/901 X |
| 1,971,382 | 8/1934 | Petersen et al. | 137/901 X |
| 3,753,448 | 8/1973 | Wright | 137/864 |
| 4,505,136 | 3/1985 | Tsay | 66/168 |
| 4,523,606 | 6/1985 | Gould | 137/627 X |
| 4,570,663 | 2/1986 | Gould | 137/627 X |
| 4,784,325 | 11/1988 | Walker et al. | 137/627 X |

FOREIGN PATENT DOCUMENTS

| | | | |
|---|---|---|---|
| 807049 | 1/1959 | United Kingdom | 66/168 |

*Primary Examiner*—M. Carter Reynolds

[57] ABSTRACT

A valve for distributing pressure air to remove lint from a knitting machine at locations where it typically accumulates, in which plural balls are normally seated in valve openings to close the flow passages to these locations and are unseated therefrom to allow the flow of pressure air when contacted by a rotating arm. Control over the movement of the ball is exercised by the seating of the ball not only in a horizontally oriented valve opening, but also in an opening of a vertical wall adjacent to the valve opening, so that the two noted horizontal and vertical openings positioned about the ball provide a desired position to the ball, and the projection of the portion of the ball through the vertical opening presents it for unseating contact by the rotating arm.

2 Claims, 2 Drawing Sheets

AIR SEQUENCER FOR A KNITTING MACHINE

This is a continuation-in-part of application Ser. No. 245,038 filed on Sept. 16, 1988.

The present invention relates to improvements for a knitting machine, and more particularly to improvements that result in effective removal of lint, using pressure air, which will otherwise accumulate at the knitting stations of this machine and cause line slubs and other such defects in the knitted fabric.

A problem in the knitting industry, to which there already has been considerable prior art effort, is how to effectively remove the lint which unavoidably will otherwise accumulate along the feed path of the yarn that is being used for knitting the fabric. One of the prior art solutions is to direct pressure air at the sites where lint accumulation is known to occur, and the pressure air burst or blast is usually effective in achieving the result intended The use of pressure air for lint removal, which is the specific prior art to which this invention is submitted as a significant advance, requires an air delivery system in the operation of which control is effectively exercised over the amount, duration of time, and other such parameters regarding the pressure air delivered to the lint-accumulation sites.

The present invention relates to such an air delivery system, herein aptly referred to as an air sequencer, which is uniquely simple in construction and operation As will, of course, be described in greater detail subsequently, the inventive air sequencer includes circumferentially spaced, plural valve balls held by pressure in a seated position within a cooperating valve opening beneath the ball and also in a seated position in a lateral direction in a retaining wall opening wherein a portion of each ball protrudes inwardly beyond said retaining wall. A contact arm is mounted for rotation within the circumferentially arranged balls and is sized to contact, in sequence, each ball and thereby temporarily unseat the ball incident to allowing pressure air through the valve opening. After the contact arm sweeps past each ball in turn, the pressure air returns each ball to its seated position within the valve opening and the ball-positioning opening in the retaining wall

EXAMPLE OF THE PRIOR ART

While there is no known prior patent in the knitting art pertinent to the within air sequencer as above generally described, prior art patents were noted which disclose the use of a sequential valve system using balls displaced from their seats by a rotating cam used with watering systems. Exemplifying these watering system prior patents is the patent to Gould, now to be discussed.

U.S. Pat. No. 4,523,606 issued on June 18, 1985 to Gould, et al., discloses many of the structural features that are embodied in the "air sequencer," as above described. More particularly, it also makes use of plural circumferentially arranged balls 56 seated in valve outlet openings 10 and displaced therefrom, one at a time by a rotating contact arm or cam 53, all as best shown in FIG. 3 To keep the balls 56 seated until displaced by the cam 53, Gould relies on the pressure of the fluid being distributed and also, as stated in col. 5, in lines 10–15, a ring 67 with depending dividers 66.

Neither Gould nor any of the other prior patents disclose the use of an encircling vertically oriented retaining wall with spaced openings therein and an operative arrangement wherein a portion of each ball protrudes inwardly beyond the retaining wall, and it is this protruding portion of the ball that is contacted by the rotating arm.

The description of the invention which follows together with the accompanying drawings would not be construed as limiting the invention to the example shown and described, because those skilled in the art to which this invention appertains will be able to devise other forms thereof within the ambit of the appended claims.

Figure 1:
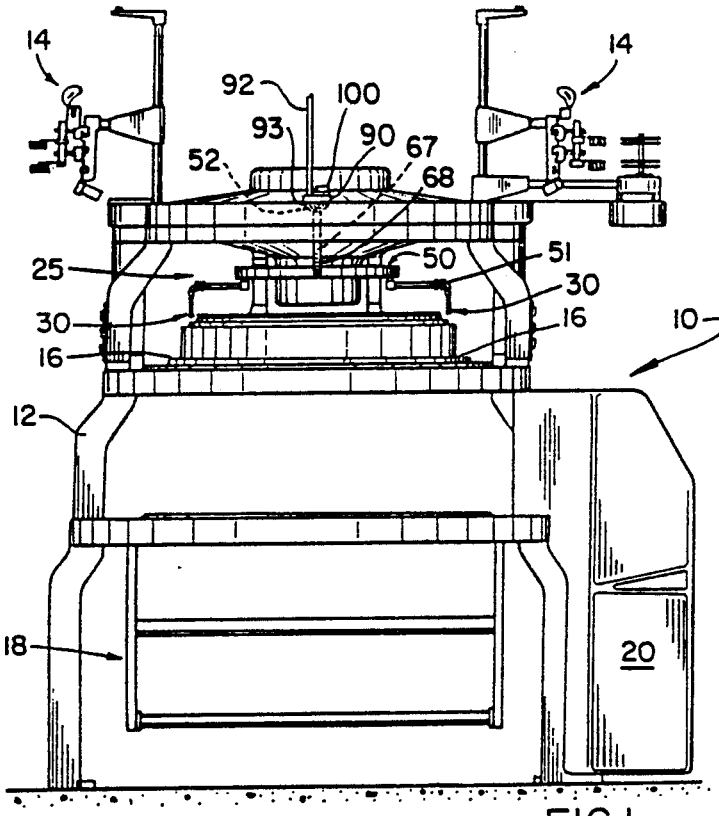
FIG. 1 is a front elevational view of a known knitting machine in the operation of which pressure air for removing lint is controlled using the valve arrangement according to the present invention.

In FIG. 1 is shown, somewhat schematically, an overall view of a knitting machine of the type known in the trade as a double knit machine. Mounted on chasis frame 12 of the machine in "downstream" sequence is a yarn feed section 14, an array of knitting stations 16, and a lower section having a take-up roller mechanism 18 therein. Suitable controls and drive mechanisms are contained within cabinet section 20.

A problem of particular concern to the knitting industry, is the accumulation of lint along the feed path of yarn used for knitting; i.e. the path from spool to knitting needle. Accumulation of lint sometimes results during the knitting of yarn into the fabric of lint slubs, thereby reducing the quality of the fabric. To correct this problem, various means of lint removal have been employed. Of particular interest in this case is an air delivery system 25 to blow away lint accumulation in the vicinity of the many knitting stations 16. Air delivery system 25 consists of an array of flutter tubes 30, a tubing chase 50, an air sequencer 90 and a remote compressed air supply 92.

To minimize drawing confusion in FIG. 1 and because they are well known as to both construction and operation, only two of the flutter tubes 30 and yarn feed positions 14 are shown. Suitable numbers of each are selected according to the model of the machine involved.

In order for flutter tubes 30 to be effective and efficient in removing lint from knitting stations 16, air from a suitable source or supply 92 must be delivered for a predetermined time on a regular cyclical basis for discharge at each station 16. It is the objective of the within inventive air sequencer 90 to accomplish this function.

Sequencer 90 is shown mounted on machine chasis 12 (FIG. 1) but may be situated in an even more remote location from the flutter tubes 30, although preferably the location selected should be overhead. Sequencer 90 has air supply 92 and an array of outlet connectors 93 to which tubings 52 are individually connected. Tubings 52 are gathered into a bundle 67 and contained within a protective shroud 68 which terminates at tubing chase 50. Within chase 50 each of the set of tubes 52 is connected to its respective and cooperating flutter tubes 30 via an adjustable piping arm 51.

Figure 2:
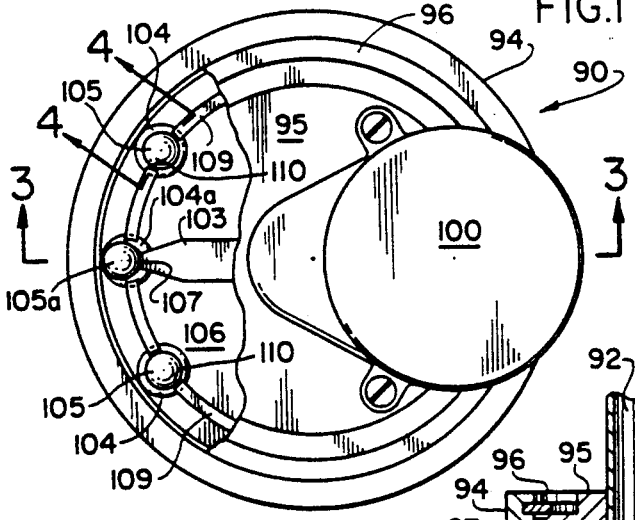
FIG. 2 is a plan view, partly broken away, of said inventive valve arrangement in isolated perspective.
Figure 3:
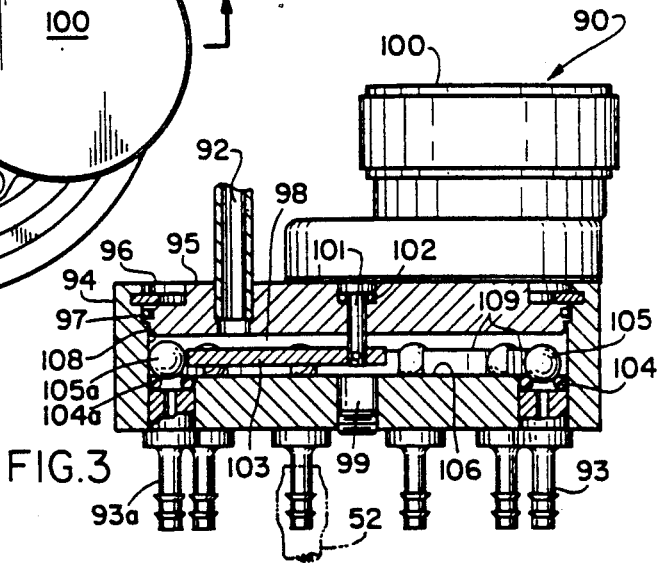
FIG. 3 is a partial cross sectional view taken along Line 3—3 of FIG. 2, showing further structural details of the valve arrangement.

As seen in FIGS. 2 and 3, sequencer 90 is comprised of a main body 94 into which a cover plate 95 is fitted. Cover 95 is locked to body 94 by retaining ring 96. O-ring 97 is used to seal plenum 98, which is formed essentially between top cover or plate 95 and a cup shaped body 94. Pressure air to plenum 98 is shown supplied at 92 through an inlet in top plate 95, but may also be effectively introduced through inlet 99, which in FIG. 3 is shown plugged close.

Mounted on top of cover plate 95 is a standard timing motor assembly 100 which, in practice, is selected to give a specific constant rotative speed to shaft 101 Shaft 101 is made to pass through a central opening in top cover 95 and cooperates with o-ring seal 102. Secured to the lowermost end of shaft 101 is a cam-like contact arm 103.

On the bottom face of sequencer body 94 there are multiple outlet connectors 93 which are circumferentially arranged at uniform intervals. On the uppermost face of each connector 93, an o-ring seal 104 is seated and arranged with its upper face flush with the lower plane 106 of plenum 98. Cooperating with each o-ring 104, is a valve ball 105; thus, the combination 104, 105 is intended to and does serve as a known type ball check valve.

As best seen in FIG. 2, contact arm 103 is shown in a position of rotation in which it is unseating ball 105*a*, and thereby allowing pressure air from plenum 98 to pass through o-ring seal 104*a* into outlet connector 93*a* which at its distal end is connected to a specific flutter tube 30 so as to blow away lint dust from a particular knitting station 16.

Since contact arm 103 has a constant angular or rotative speed valve ball 105*a* is unseated for a length of time proportionate to the width of contact tip 107. Likewise, the no-flow period, as arm 103 travels between balls 105, is proportionate to the geometry of the components.

One air sequencer, with eighteen valves and outlets is preferably used in practice and will be understood to have as duty cycle a timing of 1.75 seconds "ON" with 4.25 seconds "OFF" for each outlet As should be readily appreciated, the number of outlets and operational sequence of a sequencer is dependent on the particular application. FIGS. 2 and 3 are drawn to show a unit having ten outlet positions.

From what has already been described, it should be readily appreciated that physically confining the ball to the immediate vicinity of its cooperating valve seat is essential to the effective operation of the within air sequencer. In accordance with the present invention, this function is achieved in a unique manner, as will now be explained.

Figure 4:
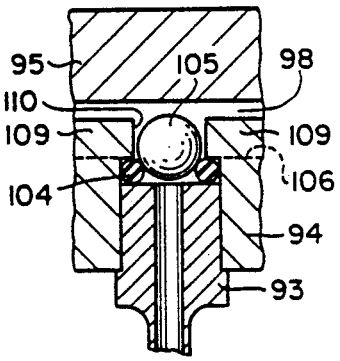
FIG. 4 is a sectional view taken along Line 4—4 of FIG. 2, showing further structural details of said valve arrangement.

As arm 103 contacts a ball 105 during its cycle, lateral movement of the ball is limited by the inner surface 108 of body 94 and in the opposite direction by arcuate segments 109A which cooperate to form a circumferential. Wall 109 extends vertically above plane 106 and allows a portion of each ball 105 to protrude inwardly for subsequent contact by arm 103. The wall segments 109A are spaced at intervals coincident with outlets 93 and have openings 110 between adjacent segments of a width size that is selected to position the vertical wall segment sides 109B at a slight clearance about the opposite sides of each cooperating ball 105. In addition to controlling movement of the balls, as best seen in FIG. 4, end portions of the wall segments 109A also extend over and retain the o-rings 104 in place. Vertical movement of the balls 105 is limited to the inner face of top plate 95 In effect the balls 105 are loose and unattached so they can be cyclically unseated by arm tip 107 from seat 104, but they are held "captive" for quick reseating after the structure described as arm 103 contacts each in turn and moves on.

Figure 5:
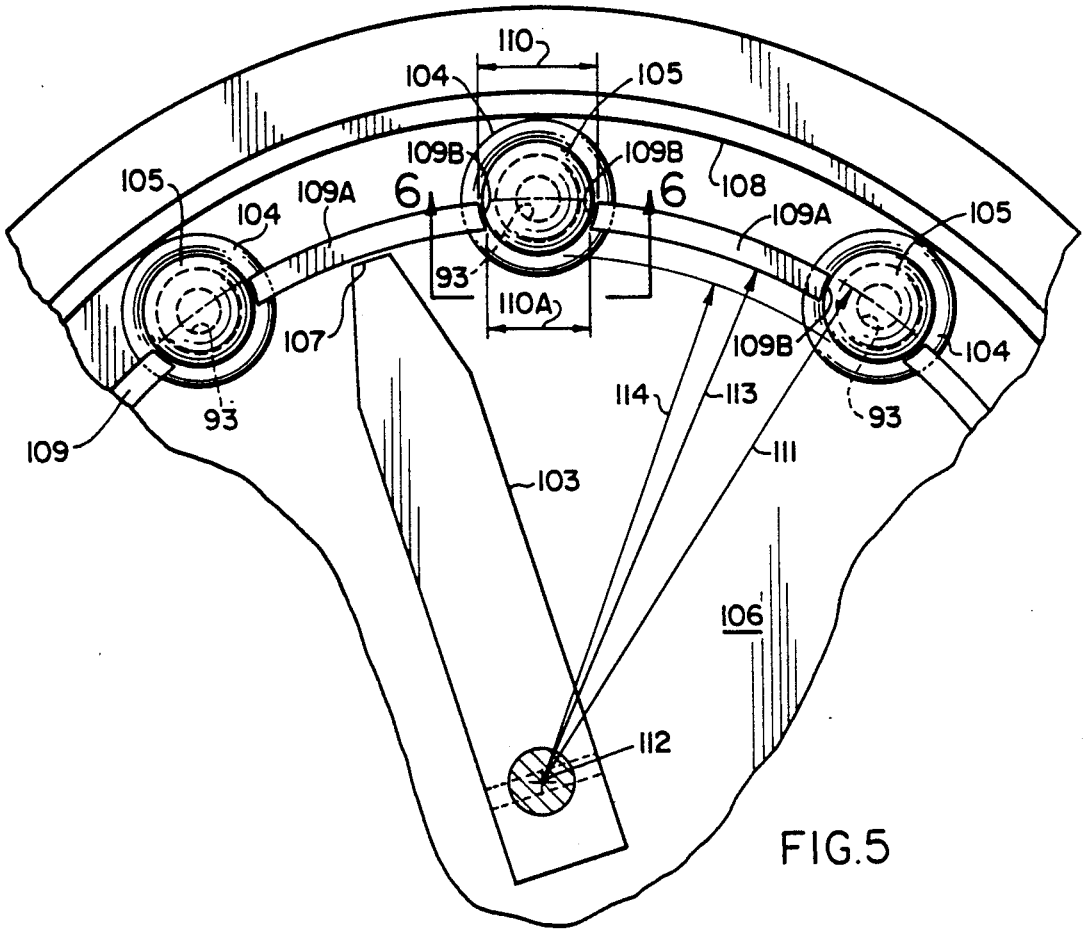
FIG. 5 is a partial plan view similar to FIG. 2, but on an increased scale, and limited to three valves.
Figure 6:
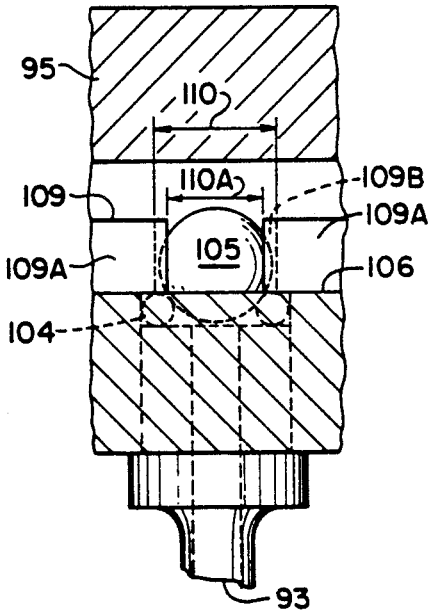
FIG. 6 is a sectional view as taken along line 6—6 of FIG. 5.

As seen in the enlarged FIGS. 5 and 6, three of the multiple valve balls, o-ring seats 104 and outlets 93 are located on a circle of a first radius 111 with respect to the sequencer vertical axis of rotation 112. Radius 111 also defines the outer side of annular wall 109. Wall 109 has an inner concentric surface that is defined by a second radius 113 which is less than radius 111. A third radius 114 defines a circle tangent to the innermost points of balls 105. Each of the ball retaining slots 110 is machined concentric about the center of its respective outlet 93 and with a radius equal to or slightly greater than ball 105 and results in arcuate surfaces 109B on wall segments 109A. The difference between radii 114 and 113 is substantial enough, as previously explained, to allow arm 103 to unseat a ball 105 as it passes each outlet position 93. Radial movement outward of each ball 105 is limited to contact with wall 108, and in an inward direction with contact with wall surfaces 109B, since the surfaces 109B are "convergent" in the direction towards axis 112. Thus, and as been best in FIG. 6, opening 110A is less than the diameter of ball 105 thereby preventing each ball 105 from movement from the immediate vicinity of its cooperating seat 104.

Sequencer 90 thus allows for a minimum of moving parts in the air delivery system 25 and results in efficient use of pressure air and effective removal of lint dust as intended. Contributing perhaps most significantly to the control that is exercised over the ball movement are the valve-like openings 110 in the wall 109, said openings 110, of course, not being openings for a valve per se since pressure air does not flow therethrough, but nevertheless, having a unique valve-like functioning in that the balls seat therein (just like they do in the valve openings 104) until they are contacted in turn by the rotating arm 103. It also will be understood that the location relationship of valve opening 104 to its cooperating wall opening 110 is such that when a ball 105 is seated in an opening 104 (FIG. 4), it is then also properly seated in an opening 10 (FIG. 2), and that this simultaneous seating in these two openings is in part the result of the pressure air acting on the ball which moves and holds each ball in these two openings until, of course, the ball is dislodged therefrom by the rotating arm 103.

While the particular air sequencer and its operational mode herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements in a knitting machine pressure air lint-removal system using a valve system of the type consisting of circumferentially spaced plural spherical valve balls each normally held by said pressure air in a seated position within a cooperating circular valve opening beneath said valve ball and adapted to be temporary unseated therefrom upon contact by rotating contact arm incident to allowing pressure air to flow past said unseated ball and through said valve opening for lint-removal service, said improvements comprising arranging said plural valve openings for said plural valve balls along an arc in circumferentially spaced relation from each other and at a first selected radius from a central vertical axis of rotation, plural spaced apart wall segments forming a vertically oriented circular wall spaced inwardly of said valve openings at a second selected radius from said central vertical axis of rotation and having between each adjacent pair of said wall segments plural ball-retaining slots in the same circumferentially spaced relation from each other as said valve openings and operatively arranged so as to provide cooperating pairs of said ball-retaining slots and valve openings in radial alignment with each other, said spherical valve walls each being of a diameter size that when each ball is seated in a cooperating circular valve opening a portion thereof is simultaneously projected through said cooperating ball-retaining slot into a rotative path established inwardly of said circular wall, and a ball-contacting arm mounted for rotative movement about said central vertical axis and of a selected length to contact each ball valve portion projected through said ball-retaining slot into said rotative path, whereby incident to being contacted, one at a time, by said rotating arm said projection of said valve balls through the confines of said ball-retaining slots contribute to preventing lateral and inward radial movements of said valve balls.

2. The improvements for a pressure air lint-removal system for a knitting machine as claimed in claim 1 including motor means for rotating said ball-contacting arm at a selected constant speed, and a ball-contacting surface on said arm of a selected dimension to provide at said constant speed a desired duration of time that said valve ball is held in an unseated condition from said valve opening and pressure air can flow therethrough for lint-removal service.

* * * * *